United States Patent [19]

Uchida

[11] 4,400,222

[45] Aug. 23, 1983

[54] METHOD FOR TREATING SURFACES

[75] Inventor: Norimasa Uchida, Matsue, Japan

[73] Assignee: Hitachi Metals, Ltd., Tokyo, Japan

[21] Appl. No.: 274,276

[22] Filed: Jun. 16, 1981

[30] Foreign Application Priority Data

| | | | |
|---|---|---|---|
| Jun. 17, 1980 | [JP] | Japan | 55-81842 |
| Jun. 17, 1980 | [JP] | Japan | 55-81843 |
| Aug. 6, 1980 | [JP] | Japan | 55-108114 |
| Aug. 6, 1980 | [JP] | Japan | 55-108115 |
| Aug. 6, 1980 | [JP] | Japan | 55-108116 |
| Aug. 6, 1980 | [JP] | Japan | 55-108117 |
| Jun. 1, 1981 | [JP] | Japan | 56-84195 |
| Jun. 1, 1981 | [JP] | Japan | 56-84196 |

[51] Int. Cl.[3] ..... B44D 5/12

[52] U.S. Cl. ..... 148/6.11; 427/431

[58] Field of Search ..... 428/471; 427/431, 399; 148/6.11

[56] References Cited

U.S. PATENT DOCUMENTS

| | | | |
|---|---|---|---|
| 3,719,518 | 3/1973 | Komatsu et al. | 428/471 |
| 3,885,059 | 5/1975 | Komatsu et al. | 427/431 |
| 3,930,060 | 12/1975 | Komatsu et al. | 427/431 |
| 4,202,705 | 5/1980 | Komatsu et al. | 427/431 |

*Primary Examiner*—Sam Silverberg

*Attorney, Agent, or Firm*—Antonelli, Terry & Wands

[57] ABSTRACT

A method for treating surfaces is provided, in which a material to be treated, such as iron, iron alloys or the like is immersed in a molten bath prepared by adding 5 to 50 weight % of a metal cementing agent consisting of one or more selected from the group consisting of a Group Va element, a substance containing the Group Va element, a Group VIa element and a substance containing the Group VIa element to a salt bath agent consisting of a neutral salt containing 5 to 30 mol % of a borate admixed therewith, to form the carbide of the Group Va element or Group VIa element or the composite carbide of these elements on the surfaces of the material. To the molten bath there may be optionally added 1 to 10 weight % of an adjuvant consisting of one or more selected from the group consisting of the oxysalts of the Groups IVa, Va and VIa elements and/or 1 to 10 weight % of a metal or an alloy thereof selected from the group consisting of a Group IVa metal and an alloy thereof.

10 Claims, 7 Drawing Figures

METHOD FOR TREATING SURFACES

DETAILED DESCRIPTION OF THE INVENTION

The present invention relates to a method for forming a carbide layer on the surface of a material, such as iron, iron alloys or the like, by immersing it in a molten bath through a molten salt process.

According to a conventional method in this field of art, as is disclosed, for example, in Japanese Patent Publication No. 19844/72, a material to be treated, such as iron, iron alloys or the like is immersed in a molten bath comprising a borate as a salt bath agent and a Group Va element as a metal cementing agent to form a layer of the carbide of the Group Va element on the surface of the material. However, since the salt bath used in this method has a high viscosity, the work is not easy to carry out and the temperature distribution in a furnace is liable not to be uniform. In addition, since the molten borate has a great effect of dissolving metal oxides into a melt, a pot may be eroded at the interface between the atmosphere and the surface of bath and largely reduced in use life. Furthermore, a large amount of melts deposited to a treated material leads to such problems as the large loss of a bath and difficulties in removing the salt from the surfaces of the treated material.

There is also known another method which comprises immersing a material to be treated into the bath of a neutral salt containing ferrovanadium or ferroniobium incorporated therein to form the carbide of vanadium or niobium on the surfaces of the material. However, this method requires the addition of a large amount, more than 30 weight %, of a metal cementing agent, which results in a marked increase in the viscosity of the bath. In addition, a favorable carbide can be formed only by immersing an object material into a precipitated layer in the bottom portion of a pot. Accordingly, the object material is difficult to deal with, and the narrow effective treating zone in a pot leads to a higher equipment cost. Furthermore, this method has other problems such as furious evaporation and poor skin finish. Thus, this method has not yet been used industrially.

Similarly, although some methods of forming a coat of titanium carbide on the surface of an object material by immersing the material into an $NaCl+Ti+TiO_2$ bath, an $NaTiCl_4+KCl+LiCl+Ti$ bath, a $K_2TiF_6+LiF+NaF+Ti$ bath, a $BaCl_2+KCl+NaCl+K_2TiF_6+Ti$ bath or the like are also known, these methods require heating in an inert atmosphere and complicated and expensive equipment. Moreover, these methods have such inconveniences as a furious evaporation and an inconstant bath composition and, therefore, have not yet been used industrially.

According to the present invention, it has been discovered that a carbide coat can be formed effectively on the surface of a material to be treated, while overcoming the various problems and inconveniences mentioned above, by immersing the material in a molten bath prepared by adding a Group Va element, a Group VIa element or substances containing these elements to a mixed salt bath agent comprising a neutral salt admixed with 5 to 30 mol % of a borate and, if needed, incorporating the oxysalts (obtained by reacting basic oxides and the oxides of the following elements) of the Group IVa element, Group Va element and/or Group VIa element, and/or Group IVa metal or alloy thereof, into the bath.

In particular, the primary characteristic feature of the present invention is to use as a salt bath agent a neutral salt admixed with 5 to 30 mol % of a borate, thereby resulting in advantages which are not obtainable by conventional methods.

More particularly, according to the present invention, a method for treating surfaces is provided, which method is characterized in that a material to be treated is immersed in a molten salt bath prepared by adding 5 to 50 weight % of a metal cementing agent of Group B (defined below) to a salt bath agent of Group A (defined below) to form a layer of the carbide of Group Va element or Group VIa element or the composite carbide of these elements on the surfaces of the material.

Group A: salt bath agent comprising a neutral salt admixed with 5 to 30 mol % of a borate;

Group B: metal cementing agent consisting of one or more selected from the group consisting of a Group Va element or substances containing the Group Va element and a Group VIa element or substances containing the Group VIa element;

Group C: adjuvant consisting of one or more salts selected from the group consisting of the oxysalts of a Group IVa element, Group Va element and Group VIa element; and Group D: one or more metals or alloys thereof selected from the group consisting of a Group IVa metal and an alloy thereof.

The method according to the present invention have solved such problems as the high viscosity of bath, the considerable erosion of pot, the deposition of large amounts of salt to the treated material and the difficulty in removing the deposited salt from the surfaces of the treated material, which have been inadvantageously involved in conventional methods utilizing only the borate as a salt bath agent. In addition, the method according to the present invention has also overcome such inconveniences as the requirement to add a large amount of the metal cementing agent, the narrow effective treating zone in the pot, the poor skin finish of the treated material and the requirement to heat in an inert atmosphere, which have been involved in conventional methods utilizing only the neutral salt as a salt bath agent.

In the present invention, the neutral salt may be used either singly or as a mixture of two or more salts. The borate may preferably be anhydrous borax, which is commercially available at relatively low cost, though the use of other borates gives substantially the same effect. In the case where one or more salts selected from NaCl, KCl, LiCl and $CaCl_2$ are used as a neutral salt, the addition of 10 to 30 mol % of a borate gives a favorable coat layer. The addition of less than 10 mol % of the borate is ineffective because it allows the occurrence of the same undesirable phenomena as in conventional neutral salt processes and, on the other hand, the addition of more than 30 mol % of the borate brings about the same undesirable phenomena as in conventional borate processes and, therefore, such addition is ineffective. The use of a salt bath which contains $BaCl_2$ as a neutral salt with 5 to 15 mol % of a borate mixed therein is most favored from an industrial point of view, since it is accompanied by little evaporation of the bath and formation of almost no precipitated layer. In this case, the addition of less than 5 mol % of the borate is ineffective for such a reason as mentioned above and, on the other hand, the addition of more than 15 mol % of the borate results in that the salts which are hardly soluble in hot water adhere to the treated material and the removal of the salts after the treatment is difficult.

The Group Va element and the Group VIa element used as a metal cementing agent may be either elemental or in the form of alloy such as ferroalloys; in any case, the cementing agent is preferably in the form of fine powder having a particle size of −60 mesh. The addition of not more than 5 weight % of a cementing agent to the salt bath agent serving as a base is sufficient to form a favorable coat layer. In contrast, conventional neutral-salt processes require the addition of more than 30 weight % of a cementing agent. Accordingly, from an economical point of view it is preferable to add 5 to 30 weight % of the cementing agent to the salt bath agent, so as to prevent the formation of precipitated layers as securely as possible. Although the addition of more than 30 weight % of a cementing agent may lead to the formation of a favorable coat layer on the treated material, the addition of more than 50 weight % of the cementing agent will largely increase the viscosity of bath to make the insertion of the material into the bath practically impossible.

Although the object of the present invention can sufficiently be attained by simply using a molten bath comprising a salt bath agent admixed with a metal cementing agent, the further addition of 2 to 10 weight % of the oxysalt of a Group Va element or Group VIa element, such as sodium vanadate, has been found to give the following excellent effects and to be advantageous from an industrial point of view:

(1) A uniform carbide layer can be formed irrespective of any position of a treating furnace at which a material to be treated is placed. In conventional methods, the carbide layer on the bath treated material located in the upper portion of furnace may be thinner than that on the material in the lower position, or, in some cases, no carbide layer may be formed on the material in the upper position. On the contrary, when the oxysalt of a Group Va element or Group VIa element is added to the bath, the carbide layer can be formed in an uniform thickness over the surface area of the treated material up to the point where the surface of bath is in contact with the atmosphere; and (2) The use life of pot is increased, because of little erosion.

Although the reason why the addition of the oxysalt of Group Va element or Group VIa element makes the resulting coat layer uniform and increases the use life of pot has not yet been fully elucidated, experiments with a variety of bath compositions reveal that it is effective to use the oxysalt in an amount of 2 to 10 weight %. The addition of less than 2 weight % of the oxysalt is not so effective and, on the other hand, the addition of more than 10 weight % of the oxysalt shortens the use life of the salt bath (the formation of the carbide coat layer will become difficult after the bath was used for 10 hours). In addition, as shown in the Examples below, any carbide cannot be formed by using only the oxysalt of a Group Va element or Group VIa element; the Group Va element, Group VIa element or substances containing the element must be used in combination.

As for the oxysalt of a Group Va element or Group VIa element, they can be used in an anhydrous state, while they, if present in a hydrated state, are preferably either dried at about 200° C. for a long period of time before added to the salt bath agent or dried together with the salt bath agent after added. It is preferable to add the oxysalt to the bath at room temperature, intimately mix the salt of acid with the salt bath agent and the Group Va element, Group VIa element or the substances containing these element and then melt the mixture by heating.

The addition of the oxysalt of a Group Va element or Group VIa element in an amount within the range prescribed according to the present invention has no adverse effects on the other conditions, that is, the viscosity of bath, evaporation of bath, ease of removal of the salt adhered to the treated material.

Furthermore, a layer of the composite carbide of Group IVa element and Group Va element or Group VIa element or a layer of the composite carbide of Group IVa element, Group Va element and Group VIa element can be formed on the surface of an object material by immersing the material in a molten salt bath prepared by adding the Group IVa metal or alloy thereof to a mixture of the agents of Groups A and B and, if necessary, Group C indicated above. In this case, if the Group Va element or Group VIa element is a metal or alloy thereof, the amount of the Group IVa element added must be in a range of 1 to 4 weight %. When the amount is less than 1 weight %, the composite carbide cannot be formed, but the carbide of only the Group Va element or Group VIa element can be formed. On the other hand, the addition of more than 4 weight % of the Group IVa element results in that the element reduces a part of the borate and inhibits the formation of the carbide coat layer, and the addition of markedly large amounts of Group IVa element leads to the formation of a layer of iron boride and, therefore, the addition of more than 4 weight % of the Group IVa element is undesirable. The total amount of the Group Va element and Group VIa element used in combination may be in a range of 5 to 40 weight %. When the total amount is less than 5 weight %, no carbide may be formed. On the other hand, when the total amount is more than 40 weight %, the viscosity of bath becomes largely increased.

When the Group Va element or Group VIa element is an oxide, the amount of the Group IVa element added must be in a range of 4 to 10 weight %. Less than 4 weight % of the Group IVa element cannot reduce any oxide sufficiently and no carbide can be formed. On the other hand, more than 10 weight % of the Group IVa element increases the viscosity of bath. The oxide of Group Va element and Group VIa element includes $V_2O_5$, $Nb_2O_5$, $V_2O_3$, $Cr_2O_3$ or the like and may be added in an amount ranging from 3 to 20 weight %. Less than 3 weight % of the oxide allows no carbide layer to be formed. On the other hand, more than 20 weight % of the oxide requires the addition of a large amount of Group IVa element as described below, resulting in markedly increasing in the viscosity of bath and making the treatment unpracticale.

The Group IVa element may be in the form of an alloy, provided that the alloy is capable of reducing the oxide of Group Va element or of Group VIa element. For example, the ferroalloy of Group IVa element may have the desired effect. The amount of the Group IVa element to be added should be greater than the stoichiometric amount, i.e., should be sufficient to reduce 80% of the total amount of the oxide of Group Va element or Group VIa element added above. Consequently, the amount of the Group IVa element added must be increased as the amount of the oxide of Group Va element or Group VIa element added is increased. The addition of the Group IVa element has an effect of increasing the use life of bath in addition to the effect of forming the composite carbides.

The salt bath agent of Group A as defined above may be used in any form. However, in order to increase the use life of bath, it is preferably to remove water and moisture from the agent by drying it at 200° to 400° C. before melting it by heating. As for the cementing agent of Group B, substances having a melting point higher than 1000° C. are preferably in the form of fine powder having a particle size of −60 mesh. Substances having a melting point not higher than 1000° C., such as $V_2O_5$, may be in any form. Like the salt bath agent of Group A, the adjuvant of Group C may be in any form, but is preferably dried well to remove water and moisture therefrom before use. The substance of Group D is preferably in the form of fine powder having a particle size of −60 mesh.

The above-mentioned bath ingredients may be mixed together at room temperature and then melted by heating in a pot, or alternatively the salt bath agent of Group A alone may first be melted by heating and the other substances may be added to the melt later.

The container or pot for use in the surface treatment of the present invention may be made of graphite or steel, one made of a heat resisting steel being most suitable from a practical viewpoint. In addition, protection of part of the container with a material having a higher resistance to corrosion or blowing of an inert gas into the container will have an effect of prolonging the use life of container.

The treatment may be conducted in air at a temperature of 850° to 1100° C., the temperature being selected according to the chemical composition and use of a material to be treated. An appropriate treatment temperature is desirably below the temperature at which grains in a heat-treated structure are not coarsened and should be the temperature at which the treatment can be conducted economically. The material to be treated is preferred to contain more than 0.3 weight % of carbon; when the carbon content of the material is not more than 0.3 weight %, the carbon content at the surface of the material is preferably increased by carburization or the like before the material is treated in the salt bath, or the salt bath may be placed in a carburizing atmosphere to attain the same purpose. In addition, the electrolyzation in the molten bath using the material to be treated as a cathode is effective for forming a preferred coat layer on the material.

After the surface treatment was completed, the treated material is pulled up from the molten salt bath and then subjected to oil quenching, water quenching or hot quenching. Tempering may be conducted in air when the tempering temperature is not higher than 500° C., but must be conducted in a non-oxidizing atmosphere when the tempering temperature is higher than 500° C.

Salts deposited on the surface of the treated material may satisfactorily be removed by maintaining the treated material in hot water for about 10 to 50 minutes and then wiping off the salts with cloth or the like.

The present invention will be understood more in detail by the study of the following descriptions of Examples, in reference to the drawings, wherein FIG. 1 is a model figure illustrating the method of immersing a specimen into a bath in order to examine the performance of the bath to form a carbide layer on the surface of the specimen;

EXAMPLE 1

Figure 1:
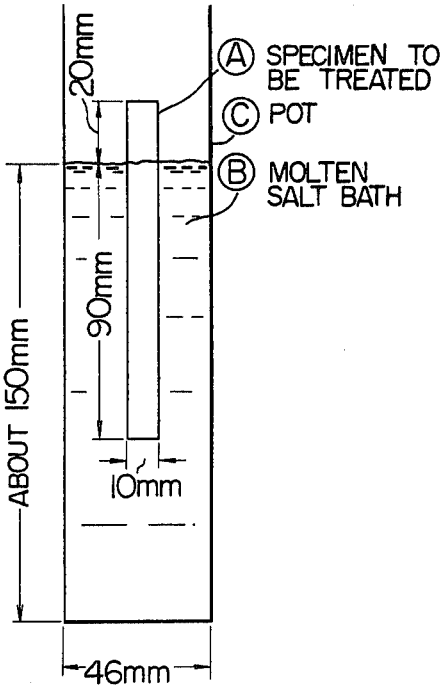

Four sample salt bath compositions as shown in Table 1, each of which had a weight of 2 kgs, were prepared. Of the four samples, Samples a and b are of the present invention, while Samples c and d are of prior arts. In preparing the sample compositions, each of the salt bath agents and $Al_2O_3$ used in this example was extra pure reagents in the form of powder, and each of ferrovanadium and ferroniobium was used in the form of fine powder having a particle size of −100 mesh. Each of the thus prepared sample bath compositions was put into a stainless steel (SUS 304)-made pot of 60 mm in diameter and 250 mm in height. The pot was placed in an electric furnace and the sample bath composition was melted by heating in air. The surface of a specimen (a material to be surface-treated), a plate of alloy tool steel (SKD 61), was ground and then degreased with trichloroethylene. The specimen was immersed in the molten salt bath at 1000° C. for 4 hours, taken out of the bath and oil-quenched. Then, after washing away the salts deposited on the treated surface of the specimen, the chemical composition and thickness of the coat layer thus formed on the surface of the specimen were determined by X-ray diffraction, X-ray microanalysis and optical microscopic analysis.

The results of the determination are shown in Table 2, together with the conditions of the bath in the treatment. The easiness to remove the salts deposited on the treated specimen is also shown. Each of the coat layers formed using the four sample bath compositions was about 7μ in thickness. The coat layer obtained using Sample c consists of two layers: an outer layer of $V_2C$ and an inner layer of VC. With Samples a and b according to the present invention, the skins obtained by the treatment were better, the amounts of salt bath evaporated were smaller, the amounts of ferrovanadium and ferroniobium to be added were smaller and, therefore, less amounts of precipitated layer were formed, as compared with Sample c of prior art. As compared with Sample d of prior art, the use of the bath compositions (Samples a and b) according to the present invention led to lower viscosities of bath and particularly to the easier washing and removal of salts deposited on the treated surfaces. This is advantageous from an industrial point of view.

TABLE 1

| Sample | Bath composition (mol %) Anhydrous borax | $BaCl_2$ | NaCl | KCl | Group Va elements and others added (weight %) Fe—V | Fe—Nb | $Al_2O_3$ | Remarks |
|---|---|---|---|---|---|---|---|---|
| a | 14 | 86 | — | — | 10 | — | — | Present |
| b | 13 | — | 42 | 45 | — | 25 | — | invention |
| c | — | — | 55 | 45 | 40 | — | 10 | Prior |
| d | 100 | — | — | — | 20 | — | — | art |

TABLE 2

| Sample | Coat layer Composition | Thickness (μ) | Conditions of bath Viscosity | Precipitated layer | Loss by evaporation | Removal of salts deposited on treated surfaces |
|---|---|---|---|---|---|---|
| a | VC | 7 | low | a little present | medium | easy, with hot water |
| b | NbC | 7 | low | a little present | medium | " |
| c | $V_2C$, VC | 7 | low | present | large | " |
| d | VC | 7 | high | absent | small | several hours' washing with boiling water needed |

EXAMPLE 2

To a salt bath agent consisting of a mixture of NaCl and anhydrous borax with a molar ratio of 70:30, there were added 10 weight % of a ferrovanadium powder having a particle size of −60 mesh and 20 weight % of a ferrochromium powder having a particle size of −60 mesh. The resultant mixture was melted by heating. The surface treatment of a specimen (SKD 11) was conducted in the same manner as in Example 1. A coat layer of about 10μ in thickness was formed on the surface of the specimen. Examination of the thus formed coat layer by X-ray diffraction and X-ray microanalysis confirmed that the layer consisted of a composite carbide of vanadium and chromium.

The conditions of the molten salt bath were generally as good as those for Sample a shown in Table 2, although a slightly larger loss by evaporation was observed. The salts deposited on the treated surface could easily be removed by washing with hot water.

EXAMPLE 3

Five sample bath compositions as shown in Table 3 were prepared, of which Samples a to c were of the present invention, while Samples d and e were or prior art. $Na_2B_4O_7$ used in preparing the bath compositions was an anhydrous extra pure reagent. $BaCl_2$ used was an industrial-grade reagent. $NaVO_3$ used was one obtained by thermally decomposing and evaporating off the water of crystallization of industrial-grade $NaVO_3.4H_2O$. Fe—V used was 76% pure and in the form of fine powder having a particle size of −100 mesh.

A specimen, which was a plate of alloy tool steel (SKD 11), was treated in each molten bath in the same manner as in Example 1. The results are shown in Table 3.

TABLE 3

| Sample | Salt bath agent (mol %) $Na_2B_4O_7$ | $BaCl_2$ | Additive (weight %) Fe—V | $NaVO_3$ | Coat layer Composition | Thickness (μ) | Remarks |
|---|---|---|---|---|---|---|---|
| a | 14 | 86 | 10 | 10 | VC | about 9 | Present |
| b | 14 | 86 | 5 | 2 | " | " | invention |
| c | 14 | 86 | 15 | — | " | " | |
| d | 100 | — | 15 | — | " | " | Prior |
| e | NaCl 55 | KCl 45 | 40 | $Al_2O_3$ 10 | $V_2C$, VC | " | art |

The use of Sample e resulted in the formation of a coat layer of a composite carbide consisting of an inner layer of VC and an outer layer of $V_2C$. In all the cases of the other bath compositions (Samples a to d), a layer of vanadium carbide VC of about 9μ in thickness was formed on the treated surface.

Figure 2:
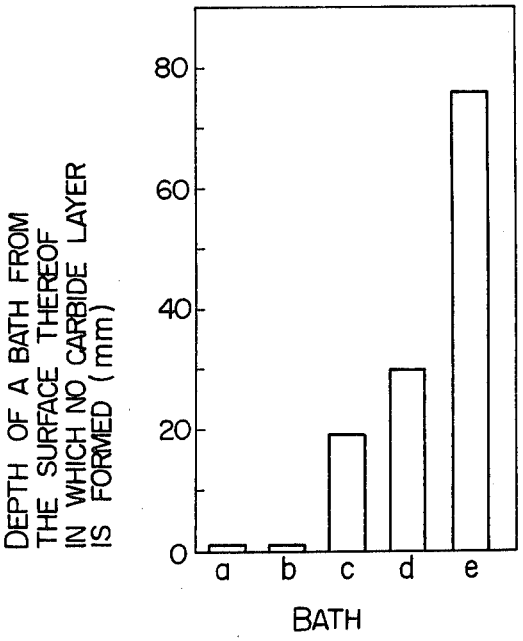
FIG. 2 is a diagram showing the surface region of the specimen where the carbide layer is not formed, for each sample bath composition.

Each of the salt bath compositions shown in Table 3 was melted by heating it to 1000° C. in a steel (SUS 304)-made pot of 46 mm in inside diameter, to form a molten salt bath which was about 150 mm in depth. After sufficiently stirring the molten bath, 5×10×110 mm specimens (SKD 11) to be treated were immersed into the bath in such a manner that its lower 90 mm portion was immersed in the bath and its upper 20 mm portion was exposed above the bath, as shown in FIG. 1. After the specimen was left to stand for 4 hours, it was taken out of the bath, then oil-quenched. The salts deposited on the treated surface of the specimen were washed away. The thickness of the coat layer at some positions of the treated surface was measured under an optical microscope, the results being shown in FIG. 2. From FIG. 2, it is seen that the formability of coat at the upper part of the bath varies depending upon the composition of salt bath. With Samples a and b containing $NaVO_3$ according to the present invention, a coat layer of vanadium carbide VC of about 9μ in thickness was found to be uniformly formed on the treated surface even at the position of almost up to the level of the surface of the salt bath. On the other hand, with Samples d and e of prior arts, no carbide layer was found to be formed on the part of the treated surface which was located in the upper region of the bath from the surface level to the level of 30 to 70 mm in depth. Although a coat layer was barely formed in the positions below said upper region, the coat layer was thin and not uniform.

Figure 3:
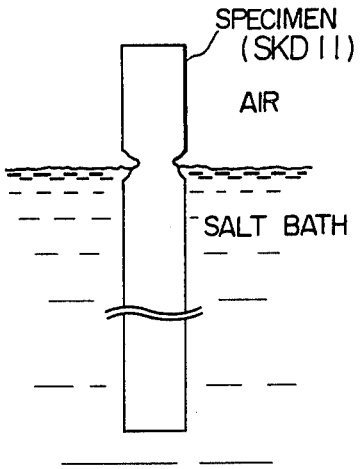
FIG. 3 is a model figure illustrating the conditions in which a steel material being surface treated is eroded at its portion located at the interface between the salt bath and the atmosphere.

Furthermore, the treated specimen was found to be eroded at the interface between the atmosphere and the surface of bath, as shown in FIG. 3. The results of measurement of the reduction in size of the specimen by erosion are shown, for each bath composition, in FIG. 4. With Samples a and b containing 2 to 10 weight % of $NaVO_3$ according to the present invention, little reduction in size of the specimen by erosion was observed. The specimens of Samples c and e were eroded only a little. On the other hand, with Sample d, the reduction in size of the specimen was larger than in the other cases, showing that Sample d had a strong eroding effect on steel.

Figure 4:
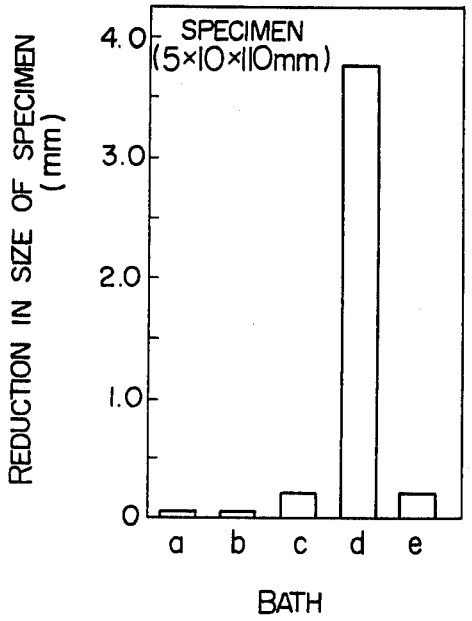
FIG. 4 is a diagram showing the reduction in size of a surface-treated material due to erosion, for each sample bath composition.

In molten salt surface treating methods which have been practised industrially, heat resisting steel has been generally used as a material for the pot. In such cases, the pot is eroded locally at the level of the surface of bath in such a manner as described above and, accordingly, the use life of pot is relatively short. To the contrary, the salt bath compositions according to the present invention have extremely weak eroding effects on steel, as shown in FIG. 4 and, hence they are advantageous in view of the use life of pot.

EXAMPLE 4

Figure 5:
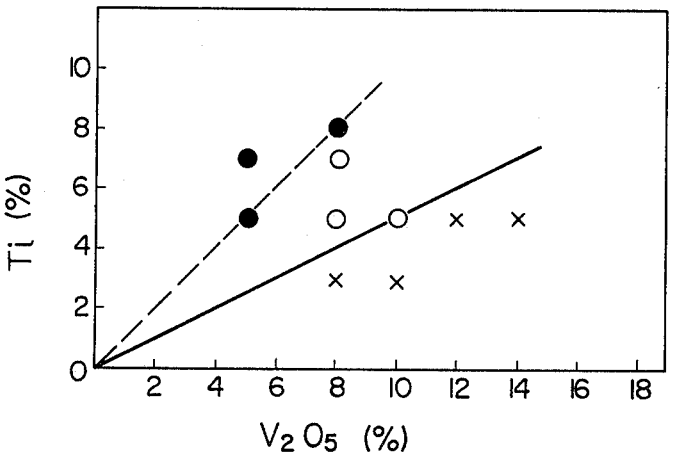
FIG. 5 is a diagram showing the compositions and crystal structures of the coat layers obtained, in terms of the mixing ratios of Ti and $V_2O_5$ in the bath used.

To a mixed salt of $Na_2B_4O_7$ and $BaCl_2$ with a molar ratio of 11:89, there were added $V_2O_5$ and a Fe—Ti powder of −100 mesh in various proportions. The thus obtained mixture was melted by heating together with a salt bath agent. Using each molten salt bath, surface treatment was conducted as in Example 1. The results are shown in FIG. 5 in terms of the admixing ratio of $V_2O_5$ and Ti. In the figure, the ring mark represents the formation of a layer of composite carbide having the chemical composition of (VTi)C and the crystal structure of VC, the whole circle mark represents the formation of a layer of composite carbide having the chemical composition of (VTi)C and the crystal structure of TiC, and the X mark represents the formation of no carbide layer. The proportion of titanium mixed Ti (%) was calculated from the purity of the Fe—Ti powder used (71.0% Ti).

Figure 6:
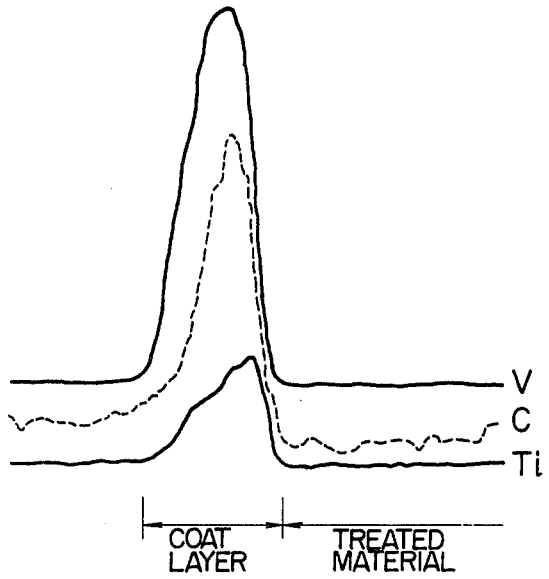
FIG. 6 is a diagram showing the results of X-ray microanalysis of element V, Ti and C in a coat layer consisting of a composite carbide in the form of a solid solution of Ti in vanadium carbide VC.
Figure 7:
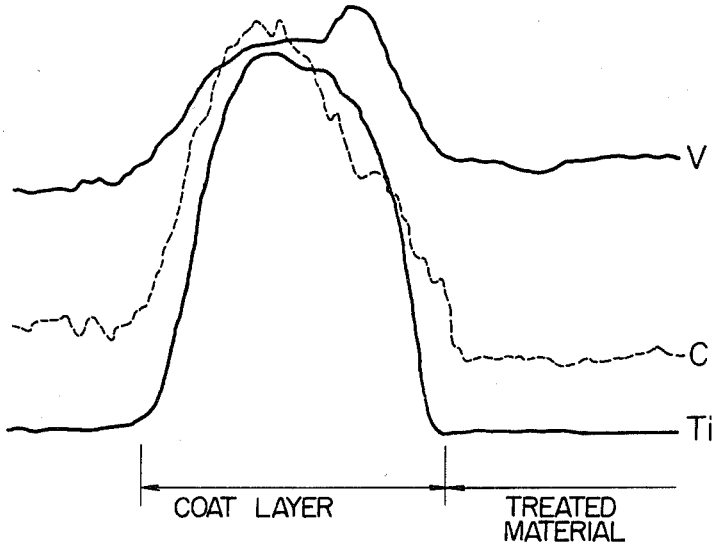
FIG. 7 is a diagram showing the results of X-ray microanalysis of elements V, Ti and C in a coat layer consisting of a composite carbide in the form of a solid solution of V in titanium carbide TiC.

The results of this example reveal that no carbide layer is formed, if the amount of Ti mixed is not more than one half of that of $V_2O_5$, which means that the critical amount of Ti for the formation of carbide layer is about 80% of the stoichiometric amount of Ti for entirely reducing the $V_2O_5$ incorporated. It was also found that all the carbide layers formed were comprised of a composite carbide of V and Ti. It was found that the crystal structure of the carbide was close to VC when the amount of Ti added meets $\frac{1}{2}V_2O_5 \leqq Ti < V_2O_5$, while the crystal structure was close to TiC when said amount meets $Ti \geqq V_2O_5$. FIG. 6 shows a typical example of the results of X-ray microanalysis of each element in the composite carbide layer formed under $\frac{1}{2}V_2O_5 \leqq Ti < V_2O_5$, from which the layer is found to consist of a solid solution of Ti in VC. FIG. 7 shows a typical example of the results of X-ray microanalysis of each element in the composite carbide layer formed under $Ti \geqq V_2O_5$, from which the layer is found to consist of a solid solution of V in TiC.

EXAMPLE 5

To a mixed salt of anhydrous borax and $BaCl_2$ with a molar ratio of 14:86, there were added 10 weight % of a ferrovanadium powder of −100 mesh and 2 weight % of a ferrotitanium powder of −100 mesh. The thus obtained mixture was melted by heating. Using the molten salt bath, a specimen (SKD 11) was surface-treated as in Example 1. A layer of the composite carbide (V, Ti)C of about 9μ in thickness was formed on the treated surface of the specimen. On the other hand, the use of the same molten bath as the above-mentioned bath, except that it contains 10 weight % of ferrovanadium and 5 weight % of ferrotitanium allowed any layer not to be formed on the treated surface of the specimen.

EXAMPLE 6

To a mixed salt of anhydrous borax and $BaCl_2$ with a molar ratio of 14:86, there were added 15 weight % of a ferrovanadium powder of −100 mesh and 4 weight % of a ferrotitanium powder of −100 mesh. Two salt baths were prepared by adding 2 weight % of $NaVO_3$ and 10 weight % of $NaVO_3$, respectively, to the mixture formed above, and melting the two thus-prepared bath compositions by heating. Using the two baths, the surface treatment of a specimen (SKD 11) was conducted as in Example 3. The layer of a (V, Ti)C type composite carbide of about 9μ thick was formed on the treated surface of the specimen in both the cases.

Next, when the surface treatment was conducted with a part of the specimen left exposed above the surface level of the bath, as shown in FIG. 1 as in Example 3, a uniform (V, Ti)C layer of about 9μ in thickness was formed on the treated surface, almost up to the part very close to the surface of the bath. In addition, no reduction in size of the specimen by erosion at the interface between the atmosphere and the surface of bath was recognized.

EXAMPLE 7

To a salt bath agent consisting of $BaCl_2$ and $Na_2B_4O_7$ with a molar ratio of 86:14, there were added 15 weight % of Fe—Nb and 3 weight % of Fe—Ti and 5 weight % of $NaNbO_3$. The thus obtained mixture was melted by heating. Using the molten salt bath, the surface treatment of a specimen was conducted, as in Example 3. The layer of composite carbide (Nb, Ti)C of about 10μ in thickness was formed on the treated surface of the specimen, uniformly and almost up to the level of the surface of the bath. Thus, the favorable effect of the addition of $NaNbO_3$ was proved. The effect of the addition of $NaNbO_3$ was confirmed also by the little reduction in size of the specimen by erosion.

What is claimed is:

1. A surface-treating method for forming the carbide or composite carbide of a Group Va element and/or Group VIa element on the surface of an iron or iron alloy material to be treated, characterized by immersing said material in a molten bath prepared by adding to (i) a salt bath agent consisting of a mixture of $BaCl_2$ and 5 to 15 mol % of $Na_2B_4O_7$, (ii) 5 to 50 weight % of a metal cementing agent consisting of one or more substances selected from the group consisting of the Group Va element, a substance containing the Group Va element, the Group VIa element and a substance containing the Group VIa element.

2. A surface-treating method for forming the carbide of a Group Va element and/or Group VIa element on the surface of an iron or iron alloy material to be treated, characterized by immersing said material into a molten bath prepared by adding to (i) a salt bath agent consisting of a mixture of $BaCl_2$ and 5 to 15 mol % of $Na_2B_4O_7$, (ii) 5 to 50 weight % of a metal cementing agent consisting of one or more substances selected from the group consisting of the Group Va element, a substance containing the Group Va element, the Group VIa element and a substance containing the Group VIa element and (iii) an adjuvant consisting of one or more substances selected from the group consisting of the oxysalts of Groups IVa, Va and VIa elements.

3. A surface-treating method for forming the composite carbide of a Group Va element or Group VIa element and Group IVa element on the surface of an iron or iron alloy material to be treated, characterized by immersing said material into a molten bath prepared by adding to (i) a salt bath agent consisting of a mixture of $BaCl_2$ and 5 to 15 mol % of $Na_2B_4O_7$, (ii) 5 to 40 weight % of a metal cementing agent consisting of one or more substances selected from the group consisting of the Group Va element, a substance containing the Group Va element, the Group VIa element and a substance containing the Group VIa element, and (iii) 1 to 10 weight % of one or more substances selected from the Group IVs metal and alloys thereof.

4. A surface-treating method for forming either (a) the composite carbide of a Group Va element or Group VIa element and a Group IVa element or (b) a composite carbide of a Group Va element, a Group VIa element and a Group IVa element on the surface of iron or iron alloy material to be treated, characterized by immersing said material into a molten salt bath prepared by adding to (i) a salt bath agent consisting of a mixture of $BaCl_2$ and 5 to 15 mol % of $Na_2B_4O_7$, (ii) 5 to 40 weight % of a metal cementing agent consisting of one or more substances selected from the group consisting of the Group Va element, a substance containing the Group Va element, the Group VIa element and a substance containing the Group VIa element, (iii) 2 to 10 weight % of an adjuvant consisting of one or more substances selected from the group consisting of the oxysalts of Groups IVa, Va and VIa elements and (iv) 1 to 10 weight % of one or more substances selected from the group consisting of the Group IVa metal and alloys thereof.

5. A surface-treating method according to claim 3 or 4, wherein the metal cementing agent is 5 to 40 weight % of one or more substances selected from the group consisting of the Group Va element, alloys thereof, Group VIa element and alloys thereof, and the molten bath contains 1 to 4 weight % of one or more substances selected from the group consisting of the Group IVa element and alloys thereof.

6. A surface-treating method according to claim 3 or 4, wherein the metal cementing agent contains 5 to 20 weight % of one or more substances selected from the group consisting of the oxides of the Group Va elements and the oxides of the Group VIa elements as well as 4 to 10 weight % of one or more substances consisting of the Group IVa elements and alloys thereof.

7. A surface-treating method according to claim 4, wherein the molten salt bath contains vanadium or its alloy as the metal cementing agent, $NaVO_3$ as the adjuvant, and titanium or its alloy.

8. A surface-treating method accoridng to claim 3, wherein the molten salt bath contains $V_2O_5$ as the metal cementing agent, and titanium or its alloy.

9. A surface-treating method according to claim 4, wherein the molten salt bath contains $V_2O_5$ as the metal cementing agent, $NaVO_3$ as the adjuvant, and titanium or its alloy.

10. A surface-treating method according to claim 1, claim 2, claim 3 or claim 4, wherein said iron or iron alloy material is formed of iron or iron alloy containing more than 0.3 weight % carbon or of iron or iron alloy containing less than 0.3 weight % carbon and having a carbon content at the surface of the material increased by carburization.

* * * * *